US009892678B2

(12) United States Patent
Song et al.

(10) Patent No.: US 9,892,678 B2
(45) Date of Patent: Feb. 13, 2018

(54) ORGANIC LIGHT EMITTING DIODE DISPLAY DEVICE

(71) Applicant: LG DISPLAY CO., LTD., Seoul (KR)

(72) Inventors: Janghoon Song, Uijeongbu-si (KR); SeokHee Jeong, Daegu (KR); ChangHeon Kang, Paju-si (KR); Jung-Min Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 70 days.

(21) Appl. No.: 14/965,195

(22) Filed: Dec. 10, 2015

(65) Prior Publication Data

US 2016/0171930 A1 Jun. 16, 2016

(30) Foreign Application Priority Data

Dec. 10, 2014 (KR) ..... 10-2014-0177877

(51) Int. Cl.
*G09G 3/3225* (2016.01)

(52) U.S. Cl.
CPC ..... *G09G 3/3225* (2013.01); *G09G 2300/043* (2013.01); *G09G 2300/0819* (2013.01); *G09G 2300/0861* (2013.01); *G09G 2310/0243* (2013.01); *G09G 2310/0262* (2013.01); *G09G 2320/0233* (2013.01); *G09G 2320/0238* (2013.01); *G09G 2320/045* (2013.01); *G09G 2320/0626* (2013.01); *G09G 2330/021* (2013.01)

(58) Field of Classification Search
CPC ..... G09G 3/3233; G09G 2300/0819; G09G 2320/045
See application file for complete search history.

(56) References Cited

U.S. PATENT DOCUMENTS

2009/0179838 A1* 7/2009 Yamashita ..... G09G 3/3233 345/84
2011/0134166 A1* 6/2011 Shirasaki ..... G09G 3/3233 345/690
2011/0285760 A1* 11/2011 Ono ..... G09G 3/3233 345/690
2013/0083087 A1* 4/2013 Byun ..... G09G 3/3233 345/690
2013/0135328 A1* 5/2013 Rappoport ..... G06F 3/0481 345/522
2014/0353629 A1* 12/2014 Jin ..... H01L 27/3262 257/40
2016/0267845 A1* 9/2016 Tsuge ..... G09G 3/3233

* cited by examiner

*Primary Examiner* — Gerald Johnson
(74) *Attorney, Agent, or Firm* — Birch, Stewart, Kolasch & Birch, LLP

(57) ABSTRACT

Provided is an OLED display device that is in a black mode in which a threshold voltage of a driving TFT need not accurately be sensed. Further, a low voltage value of zero or less is constantly and continuously supplied to a data line during an initialization period, a sampling period, and a programming period in a pixel. As a result, when the pixel is driven in the black mode, a reference voltage and a data voltage having different values are not alternately supplied to the data line to minimize power consumption.

20 Claims, 6 Drawing Sheets

ORGANIC LIGHT EMITTING DIODE DISPLAY DEVICE

CROSS-REFERENCE TO RELATED APPLICATIONS

This application claims the priority of Korean Patent Application No. 10-2014-0177877 filed on Dec. 10, 2014, in the Korean Intellectual Property Office, the disclosure of which is incorporated herein by reference.

BACKGROUND OF THE INVENTION

Field

The present disclosure relates to an organic light emitting diode (hereinafter, referred to as OLED) display device.

Description of the Related Art

Each of a plurality of pixels constituting an OLED display device includes an OLED which includes an anode, a cathode, and organic light emitting layers in between the anode and the cathode, and a pixel circuit independently driving the OLED. The pixel circuit primarily includes a switching thin film transistor (hereinafter, referred to as TFT), a capacitor, and a driving TFT. The switching of TFT charges data voltage in the capacitor in response to a scan pulse, and the driving of TFT controls an electric current amount supplied to the OLED according to the data voltage charged in the capacitor to control the amount of light emission of the OLED.

That is, the OLED display device as a self-light emitting type display device does not require a separate light source, and as a result, the OLED display device can be fabricated with a small weight and a thin film unlike a liquid crystal display device. Further, the OLED display device is researched as the next-generation display device in many different fields because the OLED display device is advantageous in terms of power consumption due to the use of low-voltage, color implementation, a response speed, a viewing angle, and a brightness contrast ratio (CR).

In the OLED display device having such advantages, differences in the threshold voltage and mobility of the driving TFT may occur for each pixel due to a process deviation, and the like. The voltage drop of a high-potential voltage VDD occurs and the amount of current driving the OLEDs varies. As a result, a luminance deviation between the pixels occurs. In general, there is a problem in that an unintended spot, stain or pattern is generated on a screen due to an initial characteristic difference of the driving TFTs. A characteristic difference due to the deterioration of the driving TFTs, which occurs while driving the OLEDs, decreases the life-span of an OLED display panel or causes an afterimage of the OLED display panel. Therefore, an attempt is continuously made to introduce a compensation circuit that compensates the characteristic deviation of the driving TFTs and compensates the voltage drop of the high-potential voltage VDD to improve an image quality by decreasing the luminance deviation between the pixels.

SUMMARY OF THE INVENTION

In recent years, while a demand for a wearable display device has rapidly increased, there has particularly been a new issue to minimize power consumption in the wearable display device having compact design. Therefore, in driving an OLED display device having a compensation circuit in a pixel structure, the need to design the pixel structure and drive the OLED display device to minimize power consumption has been a key challenge.

In order to address this and other problems, an object of the present disclosure is to provide an OLED display device and a driving method thereof, which can minimize power consumption in driving an OLED display device having a compensation circuit compensating a characteristic deviation of a driving TFT, which is provided in a pixel structure.

In order to achieve these objects, an OLED display device according to an exemplary embodiment of the present disclosure is an OLED display device which may be switched to a normal mode and a black mode according to gray scale while being driven. In other words, the OLED display device according to the exemplary embodiment of the present disclosure includes a pixel driven in a black mode when an image in which a threshold voltage of a driving TFT need not accurately be sensed.

In more detail, in the OLED display device according to the exemplary embodiment of the present disclosure, in a black mode in which a threshold voltage of a driving TFT need not accurately be sensed, a low voltage value of zero or less is constantly and continuously supplied to a data line during an initialization period, a sampling period, and a programming period in a pixel. As a result, when the pixel is driven in the black mode, reference voltage and data voltage having different values are not alternately supplied to the data line to minimize power consumption.

According to an aspect of the present disclosure, an OLED display device includes: a gate driver; a gate line extending from the gate driver; and a data line applying data voltage to a pixel which corresponds to a point where the gate line and a data line cross each other and including an internal compensation pixel driving circuit. In addition, in the OLED display device according to the aspect of the present disclosure, while the pixel implements a black color, only one voltage value is present, wherein the voltage value is applied to the pixel from the data line by applying data voltage to the pixel.

According to another aspect, an OLED display device includes: a gate driver; a gate line extending from the gate driver; and a plurality of pixels corresponding to points where the gate line and a data line cross each other and including an internal compensation pixel driving circuit. In the OLED display device according to the aspect of the present disclosure, when at least one pixel of the plurality of pixels emits light in order to display a color other than a black color, internal compensation is performed in the pixel. Further, when at least one pixel of the plurality of pixels displays the black color, the internal compensation is not performed in the pixel which displays the black color.

According to yet another aspect, an OLED display device includes: a display panel including a plurality of pixels including an OLED and an internal compensation pixel driving circuit; and a gate driver and a data driver implemented to drive the display panel, and the data driver includes a memory storing video data of the display panel. In the OLED display device according to the aspect of the present disclosure, an entire gray scale which is expressed by the pixels is divided into a low-gray scale as a gray scale close to a black and a high-gray scale as a gray scale close to a white. In accordance with the video data, the pixel corresponding to the low-gray scale is driven in a black mode in which internal compensation is not performed in the internal compensation pixel driving circuit. Further, the pixel corresponding to the high-gray scale is driven in a normal mode in which the internal compensation is performed in the internal compensation pixel driving circuit.

In the pixel driven in the black mode, DC voltage having a minus (i.e., negative) value or zero value is constantly and continuously supplied to a data line during an initialization period, a sampling period, and a programming period in a pixel. When the pixel is driven in the black mode, a reference voltage and a data voltage do not have different values so as to prevent inconstant voltage values to be supplied to the data line. As a result, power consumption can be minimized by prevention or minimization of fluctuation in voltage value which is supplied to the data line.

According to the present disclosure, an OLED display device can be provided, in which a luminance deviation among pixels is reduced by compensating a characteristic deviation of a driving TFTs among the pixels and compensating voltage drop of high-potential voltage VDD to achieve an improved image quality.

According to the present disclosure, an OLED display device can be provided, in which a capacitance ratio of the first capacitor is relatively reduced by providing a second capacitor connected to a first capacitor (for example, in series) to improve luminance of an OLED.

According to present disclosure, an OLED display device that compensates a deviation of mobility of the driving TFTs among the pixels can be provided.

According to present disclosure, an OLED display device can be provided, in which in the case where the pixel displays black, it is determined that the corresponding pixel need not accurately sense a threshold voltage of the driving TFT to drive the corresponding pixel in a black mode.

According to the present disclosure, an OLED display device can be provided, in which when the pixel is driven in the black mode, since reference voltage and data voltage having different values need not alternately be supplied to a data line of the corresponding pixel, power consumption can be minimized.

According to the present disclosure, an OLED display device can be provided, which minimizes power consumption to reduce battery consumption and minimize the size of battery.

The effects of the present disclosure are not limited to the aforementioned effects, and other various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENTS

Hereinafter, an OLED display device and a driving method thereof according to exemplary embodiments of the present disclosure will be described in detail with reference to the accompanying drawings.

In the present disclosure, a TFT may be constituted by a P type or an N type and in the exemplary embodiments described below, it is described that the TFT is constituted by the N type for easy description. Therefore, a gate high voltage VGH as a voltage higher than threshold voltage of the TFT is a gate-on voltage to turn on the TFT and a gate low voltage VGL as a voltage lower than the threshold voltage of the TFT is a gate-off voltage to turn off the TFT. In addition, in describing a pulse type signal, a state of the gate high voltage VGH is defined as "high state" and a state of the gate low voltage VGL is defined as "low state".

Figure 1:
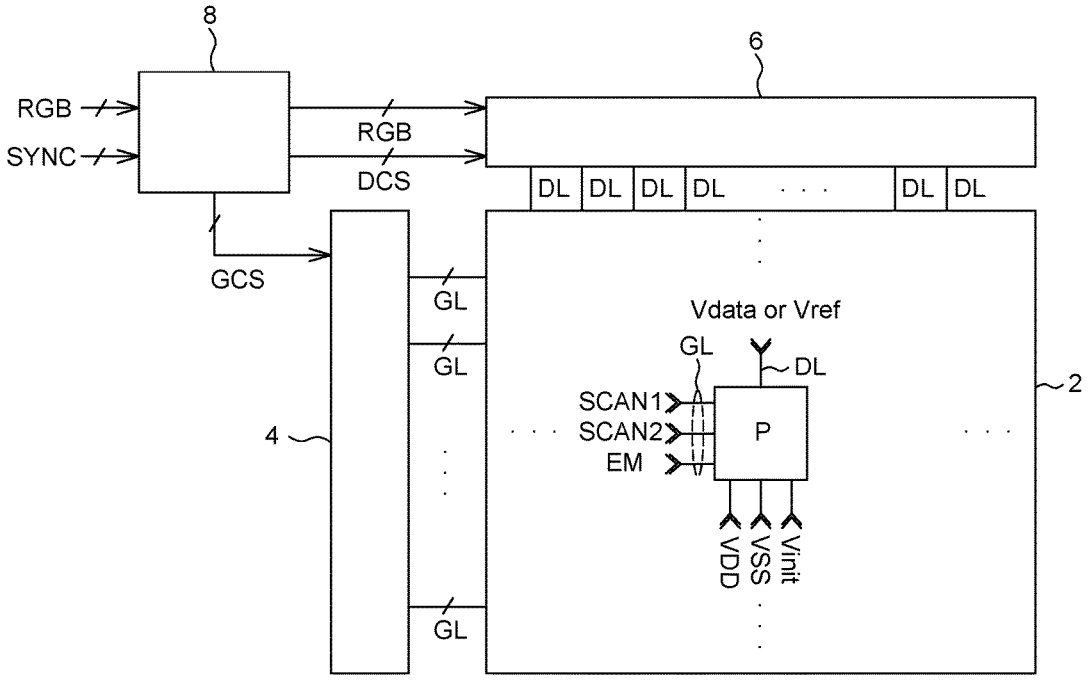
FIG. 1 is a configuration diagram of an organic light emitting diode (OLED) display device according to an embodiment of the present invention.

FIG. 1 is a configuration diagram of an organic light emitting diode (OLED) display device according to an exemplary embodiment of the present disclosure. All the components of the OLED display device according to all the embodiments of the present disclosure are operatively coupled and configured.

The OLED display device illustrated in FIG. 1 includes a display panel 2, a gate driver 4, a data driver 6, and a timing controller 8. In the display panel 2, a plurality of gate lines GLs and data lines DLs cross each other to define each pixel P. The gate driver 4 is connected with the plurality of gate lines GLs to supply electrical signals to the plurality of gate lines GLs. The data driver 6 is connected with the plurality of data lines DLs to supply electrical signals to the plurality of data lines DLs. The timing controller 8 processes video data RGB input from the outside to supply the processed video data RGB to the data driver 6 and outputs a gate control signal GCS and a data control signal DCS to control the gate driver 4 and the data driver 6.

A scheme is provided which measures a characteristic of driving TFTs outside the pixels (for example, timing controller 8) to compensate a deviation of the driving TFTs. A scheme is provided which measures a characteristic of the pixel or the characteristic of the driving TFT in the pixel outside the pixels (for example, timing controller 8), and a result measured in the timing controller disposed outside the display panel is calculated. Further, a driving voltage constituted by the sum of a data voltage and a compensation voltage is applied to each pixel to compensate the driving TFT of each pixel. A scheme is provided which may compensate the deviation of the driving TFTs by a driving integrated circuit in a pixel and a memory for compensation outside the display panel, under the system that separately performs (1) sensing the threshold voltage of the driving TFT included in a pixel driving circuit and (2) driving the pixel driving circuit when the display panel is on (i.e., the screen displays an image). These schemes belong to external compensation.

Meanwhile, a scheme is provided in which a slightly complicated pixel driving circuit including three or more TFTs is embedded, and as a result, the pixel in the display panel may autonomously compensate the deviation of the driving TFT. Further, a scheme is provided which may compensate the driving TFT of each pixel in real time while driving the display panel. That is, a scheme is provided which may compensate the deviation of the driving TFTs while sensing the threshold voltage of the driving TFT included in the pixel driving circuit and driving the pixel driving circuit during displaying an image are almost simultaneously performed. These schemes belong to internal compensation.

Each pixel P includes an OLED and the pixel driving circuit which includes a driving TFT DT supplying driving current to the OLED to independently drive the OLED. In addition, the pixel driving circuit as a pixel driving circuit capable of performing the internal compensation is configured to compensate a characteristic deviation of the driving TFT DT and voltage drop of a high-potential voltage VDD to reduce a luminance deviation between the respective pixels P.

The display panel 2 includes the plurality of gate lines GLs and the plurality of data lines DLs which cross each other and a plurality of pixels P are provided in cross areas or adjacent areas of the gate lines GLs and the data lines DLs. Each pixel P includes the OLED and the pixel driving circuit. In addition, each pixel is connected to the gate line GL, the data line DL, a high-potential voltage (VDD) supply line, a low-potential voltage (VSS) supply line, and an initialization voltage (Vinit) supply line.

The gate driver 4 supplies a plurality of gate signals to the plurality of gate lines GLs according to a plurality of gate control signals GCS provided from the timing controller 8. The plurality of gate signals includes first and second scan signals SCAN1 and SCAN2 and an emission signal EM and the signals are supplied to each pixel P through the plurality of gate lines GLs. In FIG. 1, it is illustrated that the gate driver 4 is disposed outside the display panel 2, but the gate driver 4 may be directly disposed in the display panel 2 by the same or similar process as a pixel array in a gate in panel (GIP) scheme.

A high-potential voltage VDD is relatively higher than a low-potential voltage VSS. The low-potential voltage VSS may be the ground voltage.

An initialization voltage Vinit is lower than the driving voltage of the OLED of each pixel P.

The data driver 6 converts digital video data RGB input from the timing controller 8 according to a plurality of data control signals DCS provided from the timing controller 8 into data voltage Vdata by using reference gamma voltage. In addition, the converted data voltage Vdata is supplied to a plurality of data lines DL. Meanwhile, the data driver 6 outputs the data voltage Vdata only for a programming period t3 (see FIG. 2) of each pixel P and may supply reference voltage Vref to a plurality of data lines DL for the remaining period.

The timing controller 8 processes video data RGB input from the outside according to a size and a resolution of the display panel 2 to supply the processed video data to the data driver 6. The timing controller 8 generates a plurality of gate and data control signals GCS and DCS by using synchronization signals SYNC input from the outside, for example, a dot clock signal DCLK, a data enable signal DE, a horizontal synchronization signal Hsync, and a vertical synchronization signal Vsync. In addition, the plurality of generated gate and data control signals GCS and DCS are supplied to the gate driver 4 and the data driver 6, respectively, to control the gate driver 4 and the data driver 6.

Hereinafter, the pixel P included in the OLED display device according to the exemplary embodiment of the present disclosure will be described in more detail.

The pixel P according to the exemplary embodiment of the present disclosure basically operates dividedly during an initialization period t1, a sampling period t2, a programming period t3, and a light emission period t4 according to a pulse timing of the plurality of gate signals supplied to the corresponding pixel P.

In the initialization period t1, the pixel P displays a black color by applying initialization voltage to a driving TFT DT to remove an influence by the data voltage Vdata of a previous frame before sensing the threshold voltage of the driving TFT DT of the pixel P. Therefore, initialization is achieved. For the initialization period t1, a current flow to the OLED is suppressed. The initialization period t1 is a period in which voltage applied between a gate node (that is, a first node N1 of FIG. 3) and a source node (that is, a second node N2 of FIG. 3) of the driving TFT DT of the pixel P is larger than threshold voltage Vth of the driving TFT DT. That is, the initialization period t1 is a period in which a voltage difference Vgs between the gate and the source of the driving TFT DT is larger than the threshold voltage Vth of the driving TFT DT. For example, in the pixel P driven by a pixel driving circuit according to the circuit diagram of FIG. 3, the initialization period t1 may be a period in which when a first scan signal SCAN1 is output to a high state, a second scan signal SCAN2 is output to a high state and then to a low state, an emission signal EM is output to a low state, and the reference voltage Vref is input to the data line DL.

The sampling period t2 is a period in which the threshold voltage of the driving TFT DT of the pixel P is sensed and sampled. For example, in the pixel P driven by the pixel driving circuit according to the circuit diagram of FIG. 3, the sampling period t2 may be a period in which when both the first scan signal SCAN1 and the emission signal EM are together output to a high state and simultaneously, the second scan signal SCAN2 is output to a low state, and the reference voltage Vref is input to the data line DL.

The programming period t3 is a period in which the data voltage Vdata is stored in a capacitor of the pixel P. For example, in the pixel P driven by the pixel driving circuit according to the circuit diagram of FIG. 3, the programming period t3 may be a period in which when the first scan signal SCAN1 is output to a high state and simultaneously, both the second scan signal SCAN2 and the emission signal EM are together output to a low state, and the data voltage Vdata is input to the data line DL.

A holding period may be present between the programming period t3 and the emission period t4. For example, in the pixel P driven by the pixel driving circuit according to the circuit diagram of FIG. 3, the holding period may be a period in which all of the first scan signal SCAN1, the second scan signal SCAN2, and the emission signal EM are together output to the low state. The operation of a pixel may proceed directly from the programming period t3 to the emission period t4 without the holding period.

The emission period t4 is a period in which the OLED receives current from the driving TFT DT in response to the data voltage Vdata written in the capacitor of the pixel P to emit light. For example, in the pixel P driven by the pixel driving circuit according to the circuit diagram of FIG. 3, the emission period t4 may be a period in which the emission signal EM is output to a high state and simultaneously, both the first and second scan signals SCAN1 and SCAN2 are together output to the low state.

Meanwhile, the data driver 6 of the pixel P illustrated in FIG. 1 supplies the data voltage Vdata to the plurality of data lines DL by synchronizing for the programming period t3 of each pixel P. In addition, the data driver 6 supplies the reference voltage Vref to the plurality of data lines DL by synchronizing the initialization period t1 and the sampling period t2. The data driver 6 may supply the reference voltage Vref to the plurality of data lines DL or may not supply any voltage value by synchronizing the emission period t4.

Figure 3:
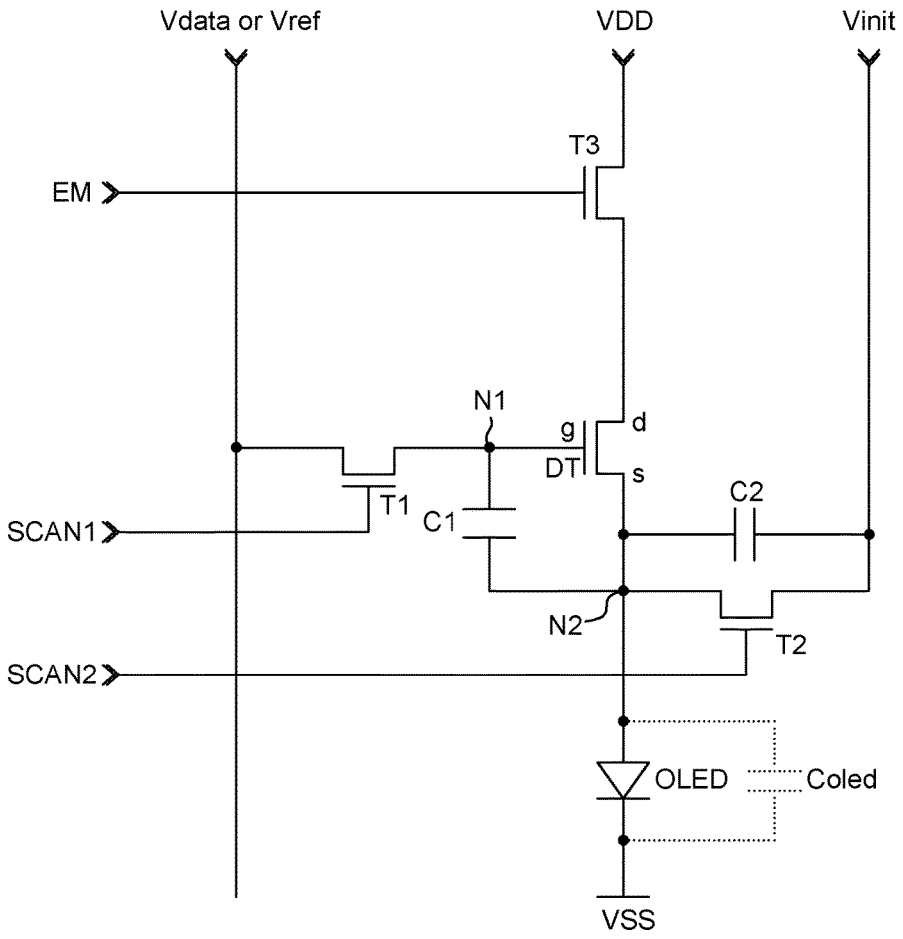
FIGS. 3, 4A, and 4B are circuit diagrams of the pixel P illustrated in FIG. 1.
Figure 4A:
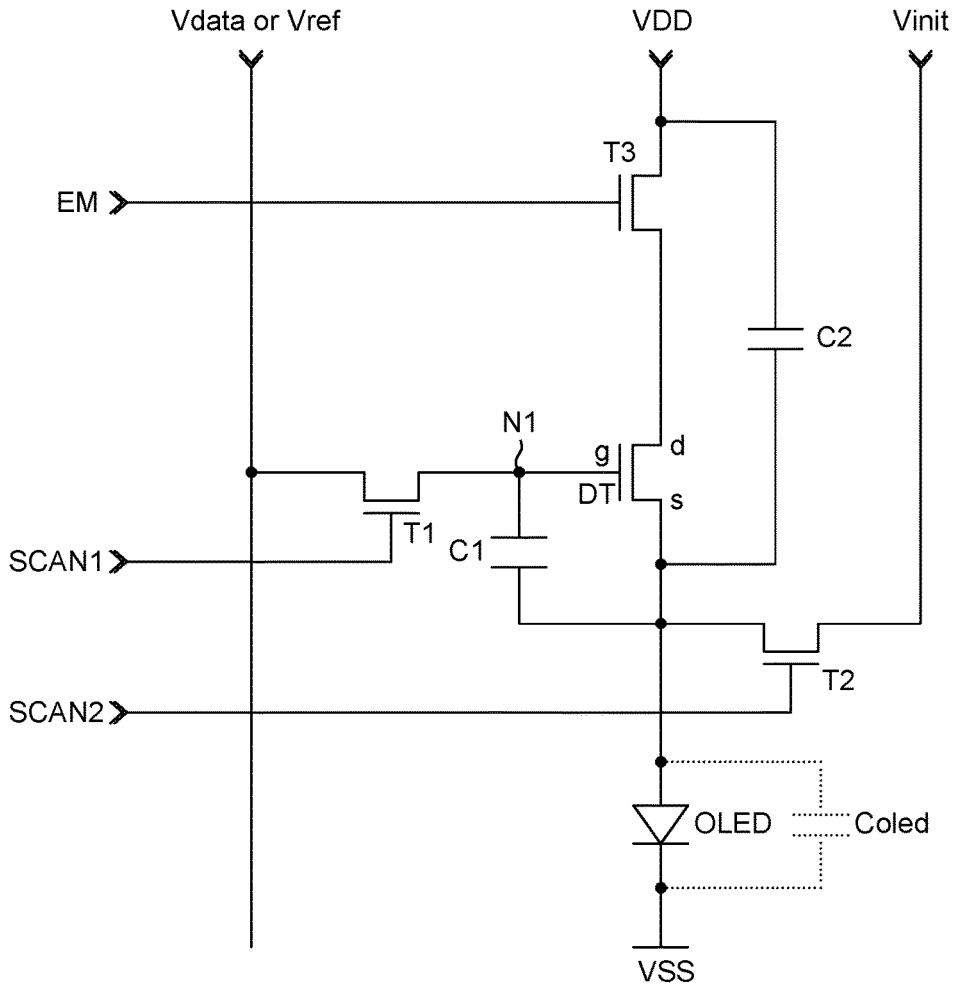
Figure 4B:
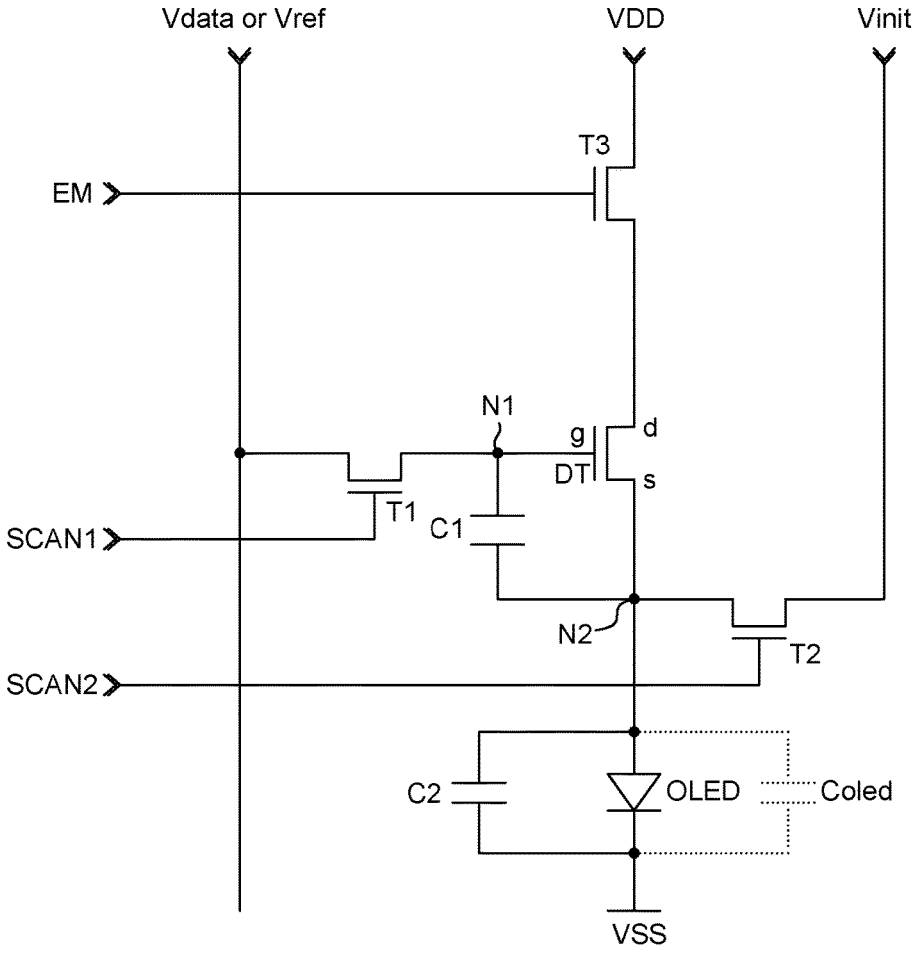

FIGS. 3, 4A, and 4B are examples of pixel driving circuits of the pixel P illustrated in FIG. 1.

Referring to FIG. 3, the pixel P includes an OLED, four TFTs including the driving TFT DT, and two capacitors and may include a pixel driving circuit driving the OLED. In detail, the pixel driving circuit of FIG. 3 includes the driving TFT DT, first to third TFTs, T1 to T3, and first and second capacitors, C1 and C2. The so-called "pixel driving circuit with a 4T2C structure" may be modified in various forms according to the overall structure and an object of the OLED display device. Further, the concepts of the present disclosure may be applied and adopted even to the pixel driving circuit with various modified different pixel structures.

The driving TFT DT is connected between a high-potential voltage VDD supply line and a low-potential voltage VSS supply line (for example, in series) with the OLED. The driving TFT DT supplies the current for driving the OLED to the OLED for the emission period t4.

The first TFT T1 is turned on or off according to the first scan signal SCAN1 and connects the data line DL and the first node N1 connected to the gate of the driving TFT DT to each other when the first TFT T1 is turned on. The first TFT T1 supplies the reference voltage Vref supplied from the data line DL to the first node N1 for the initialization period t1 and the sampling period t2. In addition, the data voltage Vdata supplied from the data line DL is supplied to the first node N1 for the programming period t3.

The second TFT T2 is turned on or off according to the second scan signal SCAN2 and connects an initialization voltage Vinit supply line and the second node N2 connected to the source of the driving TFT DT to each other when the second TFT T2 is turned on. The second TFT T2 supplies the initialization voltage Vinit supplied from the initialization voltage Vinit supply line for the initialization period t1 to the second node N2.

The third TFT T3 is turned on or off according to the emission signal EM and supplies the high-potential voltage VDD to the drain of the driving TFT DT when the third TFT T3 is turned on. The third TFT T3 supplies the high-potential voltage VDD supplied from a high-potential voltage VDD supply line to the drain of the driving TFT DT for the sampling period t2 and the emission period t4.

The first capacitor C1 is connected between the first and second nodes N1 and N2. The first capacitor C1 stores the threshold voltage Vth of the driving TFT DT for sampling period t2 and stores a voltage value obtained by adding the threshold voltage Vth of the driving TFT DT and the data voltage Vdata of the first node N1 for the programming period t3.

The second capacitor C2 is connected between the initialization voltage Vinit supply line and the second node N2. The second capacitor C2 is connected with the first capacitor C1 (for example, in series) to be implemented so that a combined capacitance value of the first capacitor C1 and the second capacitor C2 is relatively smaller than a capacitance value of the first capacitor C1 when the second capacitor C2 is not connected with the first capacitor C1 (for example, in series). As a result, the second capacitor C2 serves to improve luminance of the OLED as compared with the data voltage Vdata which is applied to the first node N1 for the programming period t3. Meanwhile, the second capacitor C2 may be connected between the high-potential voltage VDD supply line and the second node N2 as illustrated in FIG. 4*a*. In addition, as illustrated in FIG. 4B, the second capacitor C2 may also be connected between the low-potential voltage VSS supply line and the second node N2.

Since the OLED is a self-light emitting element, when the pixel P implements the black color, no current flows on the OLED of the corresponding pixel P. Nevertheless, in the display panel in the related art, when the pixel including the OLED implements the black color, a gray data value (for example, data voltage) corresponding to the black color is continuously applied to the pixel. As a result, dynamic power is continuously consumed in the data driver even though no current flows on the OLED. In other words, the pixel displays the black color having a low gray. As a result, the reference voltage and the data voltage having a lower value than the reference voltage are still alternately applied as the voltage supplied to the data line of the corresponding pixel even in the state in which no current flows on the OLED of the pixel. Therefore, power consumption of the display panel increases, and as a result, a battery is rapidly consumed or has large size for bulk capacity.

The inventors of the present disclosure attempt to address a battery consumption issue due to high power consumption of the display panel in the related art. The inventors of the present disclosure recognized that unintended spot, stain or pattern is minimized as compared with the case of implementing a relatively high-gray color when the pixel P implements the low-gray color (for example, the black color). That is, the inventors recognized that brightness contrast ratio has a significant impact on the pixel P that implements black color because an unwanted spot, stain or pattern is not recognized by a user at black color. In other words, when the respective pixels P implement the black color, an unintended spot, stain or pattern displayed on the screen, caused due to the characteristic deviation among the respective TFTs (DTs) of the respective pixels P does not become an issue. As a result, the internal compensation is not required in the pixel P implementing the black color. The characteristic deviation of the driving TFT (DT) need not be compensated when the pixel P implements the black color, for example, a process of alternately supplying the reference voltage Vref and the data voltage Vdata having different values to the data line DL is not performed. As a result, the characteristic deviation of the driving TFT (DT) may not be compensated. That is, when the pixel P implements the color black, a method of approximately or roughly sensing the threshold voltage Vth of the driving TFT (DT) or not even sensing the threshold voltage Vth by the pixel driving circuit may be adopted.

Figure 2:
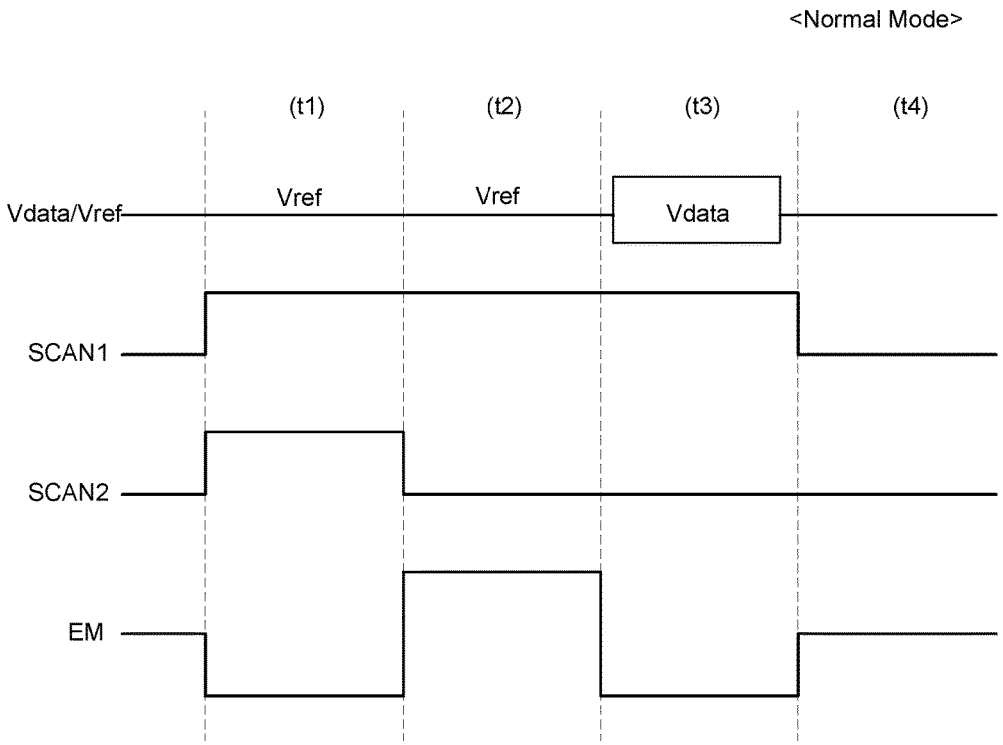
FIG. 2 is a driving timing diagram in a normal mode of a pixel P illustrated in FIG. 1.

When the pixel P implements the color black, the pixel driving circuit of the pixel P need not follow the normal mode illustrated in FIG. 2. As a result, the inventors of the present disclosure have invented an OLED display device in which the black mode is additionally introduced in addition to the normal mode, as a kind of driving mode. The black mode refers to a driving mode of the pixel driving circuit of the pixel P when any pixel P of the display panel 2 implements the color black. Alternatively, the black mode is a driving mode of the pixel driving circuit of the pixel P in the case where any pixel P is viewed as the black color by the eye of the user when the OLED display device operates. In the black mode, the internal compensation is not performed when the pixel P is driven by the pixel driving circuit. In other words, in the black mode, a process of compensating characteristic variation of the driving TFT (DT) of the pixel P is not performed. That is, a pixel driving circuit of the pixel which is driven in the black mode (1) approximately or roughly senses the threshold voltage Vth of the driving TFT (DT), or (2) not even senses the threshold voltage Vth of the driving TFT (DT). In other words, when at least one pixel of the plurality of pixels included in the display panel 2 emits light in order to display a color other than the black color, the internal compensation is performed. Further, the internal compensation is not performed when at least one pixel displays the black color.

Hereinafter, a driving method of the pixel P according to the exemplary embodiment of the present disclosure will be described with reference to various accompanying drawings.

First, in the OLED display device according to the exemplary embodiment of the present disclosure, one exemplary embodiment of the driving method of the pixel driving circuit when the pixel P is in a normal mode will be described with reference to FIGS. 2 and 3.

FIG. 2 is a driving timing diagram in a normal mode of the pixel P illustrated in FIG. 1.

Whether any pixel P is driven in the normal mode may be determined by image data (for example, video data RGB) which are temporarily stored in the data driver 6.

First, for the initialization period t1, the first TFT T1 and the second TFT T2 are turned on. Then, in the data driver 6, the reference voltage Vref supplied to the data line DL is supplied to the first node N1 through the first TFT T1. Also, the initialization voltage Vinit supplied to the initialization voltage Vinit supply line is supplied to the second node N2 and thus the pixel P is initialized. Regardless of whether the data voltage Vdata with any value is input to each pixel P before, each of the nodes N1, N2, and N3 of each pixel P has the same voltage for each pixel P through initialization. In this case, a difference between the reference voltage Vref applied to the first node N1 and the initialization voltage Vinit applied to the second node N2 becomes the voltage difference Vgs between the gate and the source of the driving TFT DT. While the pixel P is initialized, the voltage difference Vgs between the gate and the source of the driving TFT DT has a larger value than the threshold voltage Vth of the driving TFT DT.

Subsequently, for the sampling period t2, the first TFT T1 and the third TFT T3 are turned on. That is, even for the sampling period t2, the reference voltage Vref is continuously supplied to the data line DL like the initialization period t1. Further, the second TFT T2 is turned off and the third TFT T3 is turned on and thus, the first node N1 maintains the reference voltage Vref. In addition, the driving TFT DT is turned off when current flows toward the source from the drain and then the source voltage becomes "Vref−Vth" while the drain is floated to the high-potential voltage VDD.

That is, while the first TFT T1 is turned on and the voltage difference Vgs between the gate and the source of the driving TFT DT is larger than the threshold voltage Vth, the current flows in the driving TFT DT. In this case, in the driving TFT DT, current corresponding to a potential obtained by subtracting the threshold voltage Vth from the voltage difference Vgs between the gate and the source of the driving TFT DT stored in the first capacitor C1 flows. That is, until the source voltage of the driving TFT DT becomes "Vref−Vth", the current flows in the driving TFT DT. In other words, until the voltage value of the second node N2 becomes "Vref−Vth", the current flows toward the source from the drain of the driving TFT DT. Subsequently, for the programming period t3, the third TFT T3 is turned off and the first TFT T1 is turned on. Then, in the data driver 6, the data voltage Vdata supplied to the data line DL is supplied to the first node N1 through the first TFT T1.

Then, as a coupling phenomenon occurs according to voltage distribution by a serial capacitance of the first capacitor C1 and the second capacitor C2, the voltage of the second node N2 becomes "Vref−Vth+C'(Vdata−Vref)". Here, "C" represents "C1/(C1+C2+Coled)" as a combined capacitance and "Coled" represents a capacitance of the OLED. Since the second capacitor C2 connected with the first capacitor C1 (for example, in series) is additionally included, a capacitance ratio of the first capacitor C1 is relatively decreased and thus, the luminance of the OLED may be improved as compared with a case where the second capacitor C2 is not included. That is, since the second capacitor C2 is additionally included, a combined capacitance C' is smaller than the capacitance of the first capacitor C1. Thus, the luminance of the OLED according to the data voltage Vdata applied to the first node N1 for the programming period t3 may be improved as compared with the case where the capacitor C2 is not included.

For the programming period t3, since the third TFT T3 is turned off, the current does not flow in the driving TFT DT.

Subsequently, for the emission period t4, the third TFT T3 is turned on. Then, the high-potential voltage VDD is applied to the drain of the driving TFT DT through the third TFT T3 and the driving TFT DT supplies driving current to the OLED. In this case, Equation of the driving current supplied to the OLED from the driving TFT DT becomes "$Ioled=K(Vdata-Vref-C'(Vdata-Vref))^2$". In this equation, it can be seen that an effect of the threshold voltage Vth of the driving TFT DT and the high-potential voltage VDD is excluded in the driving current "Ioled" of the OLED. Accordingly, the pixel P of the present disclosure compensates for a characteristic deviation of the driving TFT DT and a voltage drop of the high-potential voltage VDD to reduce a luminance difference between the pixels P. Meanwhile, the present disclosure may compensate for a deviation of mobility among the driving TFTs DT by adjusting a rising time when the emission signal EM is converted from the low state to the high state at a start time of the emission period t4.

As such, in the OLED display device including the pixel P with the pixel driving circuit of FIG. 3, whether each pixel P is driven in the normal mode is determined based on the image data (for example, the video data RGB) which are temporarily stored in the data driver 6. In addition, the voltage supplied to each data line DL in the data driver 6 of the pixel P driven in the normal mode is continuously and repeatedly converted and supplied into the reference voltage Vref and the data voltage Vdata. When the pixel P is driven in the normal mode, the reference voltage Vref value and the data voltage Vdata value which are supplied to each data line DL in the data driver 6 have different values.

As such, in order to alternately supply the reference voltage Vref and the data voltage Vdata having different values to the data line DL of the pixel P which is constantly driven in the normal mode, in an output amplifier of the data driver 6, the reference voltage Vref and the data voltage Vdata having different values need to be continuously and alternately output. In other words, continuous supply of dynamic power to the data driver 6 is required so that the voltage value applied to the data line DL is continuously and alternately changed and applied.

Meanwhile, when the pixel P is driven in a black mode, for all periods except for the emission period t4 of the corresponding pixel P, the reference voltage Vref and the data voltage Vdata supplied to the data line DL may have the same value. That is, the reference voltage Vref value and the data voltage Vdata value supplied to the data line DL have the same value and thus, different voltage values may not be alternately supplied to the data line DL of the corresponding pixel P. That is, when the pixel P is driven in the black mode, only one sufficient and constant voltage value as (1) the data voltage Vdata with a gray value corresponding to a black color and (2) the reference voltage Vref may be applied to the data line DL of the corresponding pixel P. In order to apply one constant voltage value, it is sufficient to use DC voltage and thus, power consumption may be reduced as compared with a case where AC voltage is used for alternating supply. Meanwhile, as the voltage value with a lower value than the reference voltage Vref in the normal mode is supplied to the data line DL of the corresponding pixel P during the sampling period t2, the threshold voltage Vth of the driving TFT DT may not be accurately sensed for the sampling period t2.

As described above, when the pixel P is in the black mode, the reference voltage Vref and the data voltage Vdata having the same value are supplied to the data line DL (for example, in series) for a period in which the voltage is supplied to the data line DL of the corresponding pixel P. Thus, only one constant voltage value from the output amplifier of the data driver 6 may be input to the pixel P only when the pixel P is in the black mode. Accordingly, the consumption of the dynamic power of the data driver 6 may be reduced. As a result, the power consumption of the display panel 2 is reduced and thus, the consumption of the battery is reduced or the size of the battery is reduced. For example, when the image is displayed in the OLED display device, the entire color of the display panel 2 may be a black color such as a basic user interface (UI) environment on the screen may be implemented as a black background. When the entire color of the display panel 2 may be black, the power saving is maximized using the black mode as a driving mode of the display panel. In addition, which pixel P needs to be implemented as the black color is determined by sensing the image displayed in the OLED display device in real time and thus, the corresponding pixel P may also be driven in the black mode. As such, when the OLED display device operates so that the plurality of pixels P or most of the pixels P of the display panel 2 are implemented as the black color, the effects according to the present disclosure are further maximized.

Hereinafter, a black mode in the OLED display device according to the exemplary embodiment of the present disclosure will be described in more detail.

Image data (for example, video data RGB) displayed by the display panel 2 is stored in a memory (for example, a line memory, a frame memory, or the like) that is present in the data driver 6. Considering the image data (for example, video data RGB) stored in the memory of the data driver 6, the display panel 2 determines which gray level each pixel P is in. For example, the display panel 2 determines which gray level each pixel P corresponds to when the gray which may be expressed in the pixel P is leveled to 0 (full-black) to 255 (full-white) based on the image data (for example, video data RGB) stored in the memory of the data driver 6.

The pixel P is viewed by the user as a black color in various cases. For example, when the gray that may be expressed in the pixel P is leveled to 0 (full-black) to 255 (full-white), a case in which the corresponding pixel P corresponds to gray zero and an adjacent gray to gray zero may be regarded as the case in which the pixel P is viewed as the color black by the user. When the gray that may be expressed in the pixel P is leveled to 0 (full-black) to 255 (full-white), grays 0 to 255 are divided into a low-gray scale which may be viewed as a substantially black color and residues in other high-gray scales. The low-gray scale is viewed by the user as the color of the pixel P as the black color and the high-gray scale is viewed the color of the pixel Pas a non-black color. In general, inter-gray visual distinction in a low-gray scale is difficult to be viewed by the eye of the user as compared with inter-gray visual distinction in a high-gray scale. Therefore, the case in which the corresponding pixel P is viewed as the black color may include even a case in which the pixel P corresponds to gray zero and any one of adjacent values of gray zero.

The low-gray scale corresponding to the black mode may be defined as, for example, the case in which the corresponding pixel is gray zero. Alternatively, by considering various components such as an environment and a type of an image primarily displayed on the display panel 2, the low-gray scale corresponding to the black mode may be configured to include gray zero to the adjacent grays (i.e., gray 20 or gray 25). For example, the low-gray scale corresponding to the black mode is a gray scale at a level at which the unwanted spot, stain or pattern is not recognized by the user even though internal compensation is not performed and the section may be from gray zero to gray 25.

In this case, digital video data RGB for any pixel P is input from a digital to analog converter (DAC) of the data driver 6 to be converted and output into analog voltage considering gray expression through the digital to analog converter. Data voltage Vdata formed through an output buffer and a channel of the digital to analog converter is input into the pixel P. In this case, when the gray corresponding to the data voltage Vdata inputted to the corresponding pixel P is included in the low-gray scale, the corresponding pixel P is driven in the black mode. In addition, when the gray corresponding to the data voltage Vdata inputted to the corresponding pixel P is included in the high-gray scale, the corresponding pixel P is driven in a normal mode.

In this case, the black mode may be a mode in which the threshold voltage Vth of the driving TFT DT is not sensed in the pixel driving circuit. As a result, the internal compensation is not performed when the pixel P implements the black color. For example, the reference voltage Vref and the data voltage Vdata of the corresponding pixel P may have the same voltage value during a whole operating period other than a light emission period t4 in order to suppress the threshold voltage Vth of the driving TFT DT from being sensed. Alternatively, during the period other than the light emission period t4, the reference voltage Vref and the data voltage Vdata of the corresponding pixel P may be initialization voltage Vinit which is a negative number value. Alternatively, during the period other than the light emission period t4, voltage lower than zero as the reference voltage Vref, that is, zero or minus (i.e., negative) voltage may be supplied to the data line DL of the corresponding pixel P.

In other words, in the black mode, the threshold voltage Vth of the driving TFT DT is sensed in the pixel driving circuit during a sampling period t2, but the threshold voltage Vth of the driving TFT DT may not be accurately sensed (i.e., be only roughly sensed) when the pixel P implements the black color. For example, the black mode may be a driving mode in which when the color of the pixel P implements black, during all period other than the light emission period t4, there is a difference between the reference voltage Vref of a first node N1 and the data voltage Vdata of a second node N2. However, the difference between the reference voltage Vref and the data voltage Vdata is smaller than the threshold voltage Vth of the driving TFT DT. As a result, the threshold voltage Vth of the driving TFT DT is not substantially sensed as an accurate value.

As described above, when the data voltage Vdata lower than the data voltage Vdata corresponding to the high-gray scale driven in the normal mode is input into the corresponding pixel P, it is determined that the corresponding pixel P should be implemented as the black color and the corresponding pixel P is driven in the black mode according to the determination.

Next, an exemplary embodiment among driving methods of the pixel driving circuit when the pixel P is in the black mode in the OLED display device according to the exemplary embodiment of the present disclosure will be described with reference to FIGS. 5 and 3.

Figure 5:
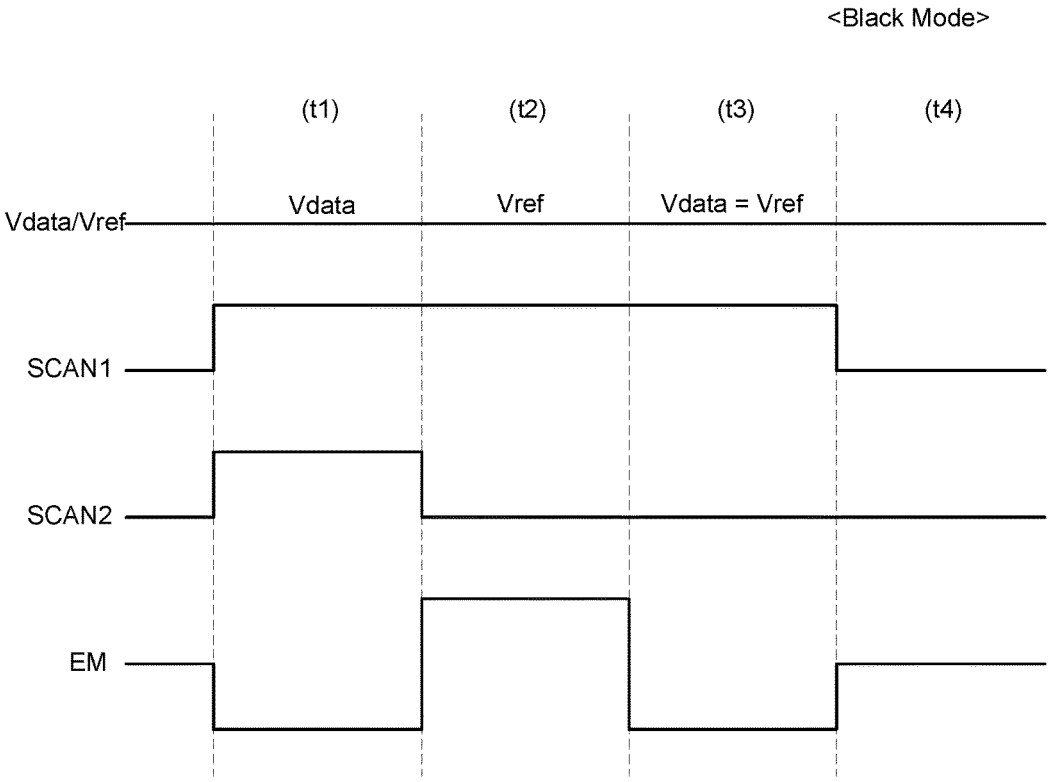
FIG. 5 is a driving timing diagram in a black mode of the pixel P illustrated in FIG. 1.

FIG. 5 is a driving timing diagram in the black mode of the pixel P illustrated in FIG. 1. Basically, description of a part which is the same as the driving timing diagram in the normal mode of the pixel P in FIG. 2 will be omitted and a part different from the driving timing diagram in FIG. 2 will be primarily described.

While driving in the black mode of the pixel P illustrated in FIG. 1, a value of the reference voltage Vref applied to the data line DL in each data driver 6 during an initialization period t1 and a sampling period t2 may be a voltage value corresponding to the low-gray scale. That is, sampling (alternatively, sensing) of the threshold voltage Vth of the driving TFT DT for the internal compensation need not be performed. Thus, it is sufficient that the data voltage Vdata corresponding to the suitable gray for implementing the black color of the pixel P as the reference voltage Vref during the initialization period t1 and the sampling period t2 is fixedly applied.

For example, when the initialization voltage Vinit fixedly applied to a supply line of the initialization voltage Vinit has a sufficiently low value as a voltage value corresponding to the low-gray scale, while driving in the black mode of the pixel P, the value of the reference voltage Vref applied to the data line DL in each data driver 6 during the initialization period t1 and the sampling period t2 may be the same as the value of the initialization voltage Vinit. For example, when the initialization voltage Vinit is the voltage value of zero or negative value, while driving in the black mode of the pixel P, the voltage value applied to each data line DL in the data driver 6 during the initialization period t1 and the sampling period t2 may also be the voltage value of zero or negative value.

Alternatively, when the ground voltage of the display panel has the voltage value corresponding to the low-gray scale, while driving in the black mode of the pixel P, the value of the reference voltage Vref applied to each data line DL in the data driver 6 during the initialization period t1 and the sampling period t2 may be the same as the value of the ground voltage.

The data voltage Vdata applied to the pixel P during a programming period t3 of $m^{th}$ frame (m is a positive integer) may have the same value as the reference voltage Vref during the initialization period t1 and sampling period t2 of $m-1^{th}$ frame.

That is, during a period when the voltage is supplied to the pixel P through the data line DL of the pixel P driven in the black mode, direct current having only one voltage value may be supplied to the pixel P through the data line DL. Therefore, while driving the pixel P driven in the black mode, supplying dynamic power to the data driver 6 is not required.

Further, in the pixel P driven in the black mode, during all residual periods other than the light emission period t4, one voltage value may be continuously supplied to the data line DL. Therefore, a gate-source voltage difference Vgs of the driving TFT DT has a value substantially close to zero. In this case, one voltage value applied to the data line DL may be the same voltage value as the initialization voltage Vinit, for example, the voltage value of zero or negative value in order to satisfy a condition as the data voltage Vdata corresponding to the low-gray scale.

In more detail, during the period when the voltage is supplied to the data line DL of the pixel P in the black mode, when the pixel P implements the black color, appropriate DC voltage at a level to assure a brightness contrast ratio of the black color needs to be constantly supplied to the data line DL. That is, in order to implement black color in the pixel P, the voltage supplied to the data line of the corresponding pixel P needs to be particularly lower than OLED driving voltage. To this end, exemplarily, voltage which is the same as the initialization voltage Vinit as voltage used for initializing the pixel driving circuit may be supplied to the data line DL of the corresponding pixel P. That is, the voltage supplied to the data line Dl of the pixel P in the black mode may have the same value as the voltage supplied to the supply line of the initialization voltage Vinit. When the voltage which is the same as the initialization voltage Vinit is supplied to the data line DL of the corresponding pixel P, a voltage value of the second node N2 is the same as a voltage value of the third node N3. In other words, in the OLED display device according to the exemplary embodiment of the present disclosure, when the pixel P implements the black color, an appropriate DC voltage at a level to assure both (1) initialization of the pixel driving circuit and (2) the brightness contrast ratio of the black color may be supplied to the data line DL of the corresponding pixel P.

In the OLED display device according to the exemplary embodiment of the present disclosure, at least one pixel of a plurality of pixels P constituting the entirety of the display panel 2 may be driven or switched between the black mode and the normal mode.

For example, only some pixels among all pixels P included in the display panel 2 may be driven and switched between the black mode and the normal mode. That is, only aggregate group of the pixels P corresponding to a part of the display panel 2, that is, a part of the display panel 2 may be driven and switched between the black mode and the normal mode. In this case, the time switching from the black mode to the normal mode or from the normal mode to the black mode may be the same for each pixel among the plurality of pixels constituting the group of the pixels P corresponding to a part of the display panel 2. Alternatively, the time switching from the black mode to the normal mode or from the normal mode to the black mode may vary for each pixel among the plurality of pixels constituting the group of the pixels P corresponding to a part of the display panel 2.

For example, all pixels P included in the display panel 2 may be driven and switched between the black mode and the normal mode. In this case, all pixels P included in the display panel 2 may be simultaneously driven and switched from the black mode to the normal mode or from the normal mode to the black mode. Alternatively, the time when all pixels included in the display panel 2 may be simultaneously driven and switched from the black mode to the normal mode or from the normal mode to the black mode may vary for each pixel. A case where all pixels P included in the display panel 2 are individually driven and switched from the black mode to the normal mode or from the normal mode to the black mode is most effective in terms of reducing power consumption.

In the OLED display device according to the exemplary embodiment of the present disclosure, only when all grays corresponding to the data voltage Vdata input into the plurality of pixels P constituting the entirety of the display panel 2 correspond to the low-gray scale, the respective pixels P may be driven together in the black mode. That is, the pixels may be simultaneously driven and switched between the black mode and the normal mode by the unit of the entirety (for example, all pixels constituting the screen or one frame) of the display panel 2. In this case, the case is effective in that the pixels are integrally driven and switched without the need to control the driving and switching of each pixel.

Alternatively, only when all grays corresponding to the data voltage Vdata input into the plurality of pixels P constituting at least one horizontal line correspond to the low-gray scale, the respective pixels P constituting at least one horizontal line may be together driven in the black mode. That is, the pixels may be simultaneously driven and switched between the black mode and the normal mode by the unit of the horizontal line of the display panel 2. In this case, the black mode and the normal mode which vary may be driven and switched between the respective horizontal lines. In this case, the case is effective in that the driving and switching need not be controlled for each pixel in the plurality of pixels P constituting at least one horizontal line.

Alternatively, the group of the pixels P corresponding to a part of the display panel 2, that is, a part of the display panel 2 may be simultaneously driven and switched between the black mode and the normal mode. In this case, only when all grays corresponding to the data voltage Vdata input into the plurality of pixels P constituting the group of the pixels P, respectively correspond to the low-gray scale, the respective pixels P corresponding to a part may be driven together in the black mode. The group of the pixels P corresponding to the part may be, for example, the plurality of pixels P constituting one or more horizontal lines. Alternatively, the group of the pixels P corresponding to the part may indicate, for example, a group of pixels P corresponding to a part which is in an inactive state in the display panel 2 when the display panel 2 just displays only simple information such as a logo, a mark, a time or a date and is in a stand-by state for use of the user.

An OLED display device according to various exemplary embodiments of the present disclosure may be described as below.

The OLED display device according to an exemplary embodiment of the present disclosure includes: a gate driver; a gate line extending from the gate driver; and a data line applying data voltage to a pixel which corresponds to a point where the gate line and a data line cross each other and including an internal compensation pixel driving circuit. In addition, in the OLED display device according to the exemplary embodiment of the present disclosure, while the pixel implements a black color, only one voltage value is present, wherein the voltage value is applied to the pixel from the data line by applying data voltage to the pixel.

Further, in the OLED display device according to the exemplary embodiment of the present disclosure, the voltage value is zero or a minus (i.e., negative) value.

Further, in the OLED display device according to the exemplary embodiment of the present disclosure, the voltage value is input as direct current.

Further, in the OLED display device according to the exemplary embodiment of the present disclosure, an entire gray scale which is expressed in the pixel is leveled to 0 to 255. The entire gray scale is divided into a low-gray scale of 0 to 25 and a high-gray scale of 26 to 225, and the black color corresponds to a color of the low-gray scale.

Further, in the OLED display device according to the exemplary embodiment of the present disclosure, the voltage value is the same as a value of initialization voltage supplied from an initialization voltage supply line.

In another aspect, an OLED display device according to an exemplary embodiment of the present disclosure includes: a gate driver; a gate line extending from the gate driver; and a plurality of pixels corresponding to points where the gate line and a data line cross each other and including an internal compensation pixel driving circuit. In the OLED display device according to the exemplary embodiment of the present disclosure, when at least one pixel of the plurality of pixels emits light in order to display a color other than a black color, internal compensation is performed and the internal compensation is not performed when at least one pixel displays the black color.

Further, in the OLED display device according to the exemplary embodiment of the present disclosure, at least one pixel of the plurality of pixels does not sense, or only roughly sense, threshold voltage of a driving TFT included in the internal compensation pixel driving circuit at the time of displaying the black color.

Further, in the OLED display device according to the exemplary embodiment of the present disclosure, at least one pixel of the plurality of pixels includes all pixels included in the display panel.

In yet another aspect, an OLED display device according to an exemplary embodiment of the present disclosure includes: a display panel including a plurality of pixels including an OLED and an internal compensation pixel driving circuit; and a gate driver and a data driver implemented to drive the display panel, and the data driver includes a memory storing video data of the display panel. In the OLED display device according to the exemplary embodiment of the present disclosure, an entire gray scale which is expressed by the pixels is divided into a low-gray scale as a gray scale close to a black and a high-gray scale as a gray scale close to a white. Further, in accordance with the video data, the pixel corresponding to the low-gray scale is driven in a black mode in which internal compensation is not performed in the internal compensation pixel driving circuit. Also, the pixel corresponding to the high-gray scale is driven in a normal mode in which the internal compensation is performed in the internal compensation pixel driving circuit.

Further, the OLED display device according to the exemplary embodiment of the present disclosure further includes: a gate driver connected with a gate line and a data driver connected with a data line. The internal compensation pixel driving circuit is connected to the gate line, the data line, and an initialization voltage supply line, and in the black mode. While the pixel implements a black color, only one voltage value is present, wherein the voltage value is applied to the pixel from the data line by applying data voltage to the pixel.

Further, in the OLED display device according to the exemplary embodiment of the present disclosure, one predetermined voltage value is zero or a minus (i.e., negative) value.

Further, in the OLED display device according to the exemplary embodiment of the present disclosure, one predetermined voltage value is the same as a value of initialization voltage supplied to the initialization voltage supply line.

Further, in the OLED display device according to the exemplary embodiment of the present disclosure, one predetermined voltage value is applied as direct current.

Further, in the OLED display device according to the exemplary embodiment of the present disclosure, the internal compensation pixel driving circuit includes an OLED and a driving TFT driving connected with the OLED (for example, in series) to drive the OLED. In the normal mode, characteristic variation of the driving TFT of the pixel corresponding to the high-gray scale is compensated in the internal compensation pixel driving circuit. However, in the black mode, the characteristic variation of the driving TFT of the pixel corresponding to the low-gray scale is not compensated in the internal compensation pixel driving circuit.

Further, in the OLED display device according to the exemplary embodiment of the present disclosure, the internal compensation pixel driving circuit includes an OLED and a driving TFT driving connected with the OLED (for example, in series) to drive the OLED. In the normal mode, threshold voltage of the driving TFT of the pixel corresponding to the high-gray scale is sensed in the internal compensation pixel driving circuit. However, in the black mode, the threshold voltage of the driving TFT of the pixel corresponding to the low-gray scale is not sensed in the internal compensation pixel driving circuit.

Further, in the OLED display device according to the exemplary embodiment of the present disclosure, the internal compensation pixel driving circuit includes an OLED and a driving TFT driving connected with the OLED (for example, in series) to drive the OLED. The black mode is a driving mode including a period in which a difference between gate voltage and source voltage of the driving TFT is driven to be smaller than the threshold voltage of the driving TFT.

Further, in the OLED display device according to the exemplary embodiment of the present disclosure, only a group of pixels corresponding to a predetermined part of the display panel is implemented to perform as a switch between driving in the black mode and driving in the normal mode.

Further, in the OLED display device according to the exemplary embodiment of the present disclosure, the switch between driving in the black mode and driving in the normal mode is implemented to perform by the unit of a frame of the display panel.

Further, in the OLED display device according to the exemplary embodiment of the present disclosure, only when grays corresponding to data voltage input into each of a plurality of pixels constituting the group of pixels corresponding to a part of the display panel to a low-gray scale, the group of pixels corresponding to a part of the display panel are simultaneously driven in the black mode.

Further, in the OLED display device according to the exemplary embodiment of the present disclosure, the group of pixels corresponds to a part which is in an inactive state in the display panel when the display panel just displays only simple information such as a logo, a mark, a time or a date and is in a stand-by state for use.

As described above, according to the present disclosure, an OLED display device can be provided, in which a luminance deviation among pixels is reduced by compensating a characteristic deviation of a driving TFT, and voltage drop of high-potential voltage to achieve an improved image quality.

Further, according to the present disclosure, an OLED display device can be provided, in which a capacitance ratio of the first capacitor is relatively reduced by providing a second capacitor connected to a first capacitor (for example, in series) to improve luminance of an OLED.

In addition, according to present disclosure, an OLED display device that compensates a deviation of mobility of the driving TFT (DT) of the pixels can be provided.

Further, according to present disclosure, an OLED display device can be provided, in which in the case where the pixel displays a black, it is determined that the corresponding pixel need not accurately sense a threshold voltage of the driving TFT to drive the corresponding pixel in a black mode.

Further, according to the present disclosure, an OLED display device can be provided, in which when the pixel is driven in the black mode, during a sampling period of the corresponding pixel, reference voltage Vref having a value of zero or less is supplied to a data line DL.

Further, according to the present disclosure, an OLED display device can be provided, in which when the pixel is driven in the black mode, during a data period of the corresponding pixel, a value of data voltage Vdata supplied to the data line DL is the same as a value of the reference voltage Vref applied during the sampling period.

Further, according to the present disclosure, an OLED display device can be provided, in which when the pixel is driven in the black mode, during a period when voltage is supplied to the data line DL of the corresponding pixel, the supplied voltage is DC voltage having a predetermined value of zero or less.

Further, according to the present disclosure, an OLED display device can be provided, in which the reference voltage Vref and the data voltage Vdata having the same value is supplied to the data line DL of the pixel in the black mode. As a result, a source amplifier of the data driver 6 can constantly output the same voltage value.

Further, according to the present disclosure, an OLED display device can be provided, in which when the pixel is driven in the black mode, since the reference voltage and data voltage having different values need not alternately be supplied to a data line of the corresponding pixel, power consumption can be minimized.

Further, according to the present disclosure, an OLED display device can be provided, in which when the pixel is driven in the black mode, consumption of dynamic power can be reduced. Thus, power consumption decreases, and as a result, battery consumption is reduced.

The aforementioned present disclosure is not limited to the aforementioned exemplary embodiments and the accompanying drawings, and it will be obvious to those skilled in the technical field to which the present disclosure pertains that various substitutions, modifications, and changes may be made within the scope without departing from the technical spirit of the present disclosure.

What is claimed is:

1. A display panel comprising:

a gate driver;

a gate line extending from the gate driver;

a data line applying a data voltage to a pixel which corresponds to a point where the gate line and the data line cross each other, the pixel including an internal compensation pixel driving circuit, wherein the internal compensation pixel driving circuit includes a driving thin film transistor (TFT), and first and second capacitors connected in series and coupled to the driving TFT, wherein while the pixel implements a black color, only one voltage value is present, and wherein the voltage value is applied to the pixel from the data line.

2. The display panel according to claim 1, wherein the voltage value is zero or a negative value.

3. The display panel according to claim 1, wherein the voltage value is input as a direct current.

4. The display panel according to claim 1, wherein:

when an entire gray scale in the pixel is leveled from 0 to 255, the entire gray scale is divided into a low-gray scale of 0 to 25 and a high-gray scale of 26 to 225, and the black color corresponds to a color of the low-gray scale.

5. The display panel according to claim 1, wherein the voltage value is the same as a value of an initialization voltage supplied from an initialization voltage supply line.

6. A display panel comprising:

a gate driver;

a gate line extending from the gate driver; and a plurality of pixels corresponding to points where the gate line and a data line cross each other, and including an internal compensation pixel driving circuit, wherein the internal compensation pixel driving circuit includes a driving thin film transistor (TFT), and first and second capacitors connected in series and coupled to the driving TFT, and wherein internal compensation is performed when at least one pixel of the plurality of pixels emits light in order to display a color other than a black color, and the internal compensation is not performed when at least one pixel shows the black color.

7. The display panel according to claim 6, wherein at least one pixel of the plurality of pixels does not sense or only roughly sense a threshold voltage of the driving TFT included in the internal compensation pixel driving circuit when displaying the black color.

8. The display panel according to claim 6, wherein at least one pixel of the plurality of pixels includes all pixels included in the display panel.

9. An organic light emitting diode (OLED) display device comprising:

a display panel including a plurality of pixels including an OLED and an internal compensation pixel driving circuit, wherein the internal compensation pixel driving circuit includes a driving thin film transistor (TFT), and first and second capacitors connected in series and coupled to the driving TFT; and a gate driver and a data driver implemented to drive the display panel, wherein the data driver includes a memory storing image data of the display panel, an entire gray scale is divided into a low-gray scale as a gray scale close to a black and a high-gray scale as a gray scale close to a white, and in accordance with the video data, the pixel corresponding to the low-gray scale is driven in a black mode in which internal compensation is not performed in the internal compensation pixel driving circuit and the pixel corresponding to the high-gray scale is driven in a normal mode in which the internal compensation is performed in the internal compensation pixel driving circuit.

10. The OLED display device according to claim 9, further comprising:

a gate driver connected with a gate line and a data driver connected with a data line, wherein the internal compensation pixel driving circuit is connected to the gate line, the data line, and an initialization voltage supply line, and in the black mode, while the pixel implements a black color, only one voltage value is present, wherein the voltage value is applied to the pixel from the data line.

11. The OLED display device according to claim 10, wherein one predetermined voltage value is zero or a negative value.

12. The OLED display device according to claim 10, wherein one predetermined voltage value is the same as a value of initialization voltage supplied to the initialization voltage supply line.

13. The OLED display device according to claim 10, wherein one predetermined voltage value is applied as a direct current.

14. The OLED display device according to claim 9, wherein:

the internal compensation pixel driving circuit includes an OLED and the driving TFT connected with the OLED to drive the OLED, in the normal mode, a characteristic variation of the driving TFT of the pixel corresponding to the high-gray scale is compensated in the internal compensation pixel driving circuit, and in the black mode, the characteristic variation of the driving TFT of the pixel corresponding to the low-gray scale is not compensated in the internal compensation pixel driving circuit.

15. The OLED display device according to claim 9, wherein:

the internal compensation pixel driving circuit includes an OLED and the driving TFT driving connected with the OLED to drive the OLED, in the normal mode, a threshold voltage of the driving TFT of the pixel corresponding to the high-gray scale is sensed in the internal compensation pixel driving circuit, and in the black mode, the threshold voltage of the driving TFT of the pixel corresponding to the low-gray scale is not sensed in the internal compensation pixel driving circuit.

16. The OLED display device according to claim 9, wherein:

the internal compensation pixel driving circuit includes an OLED and the driving TFT driving connected with the OLED to drive the OLED, and the black mode is a driving mode including a period in which a difference between a gate voltage and source voltage of the driving TFT is driven to be smaller than the threshold voltage of the driving TFT.

17. The OLED display device according to claim 9, wherein the switch between the driving in the black mode and driving in the normal mode is implemented to be performed by the unit of a frame of the display panel.

18. The OLED display device according to claim 9, wherein only a group of pixels corresponding to a part of the display panel is implemented to switch between driving in the black mode and driving in the normal mode.

19. The OLED display device according to claim 18, wherein only when gray scales corresponding to data voltage input into all of pixels in the group of pixels corresponding to a part of the display panel correspond to a low-gray scale, the group of pixels corresponding to a part of the display panel are simultaneously driven in the black mode.

20. The OLED display device according to claim 18, wherein the group of pixels is a group of pixels corresponding to a part which is in an inactive state in the display panel when the display panel just displays only simple information including a logo, a mark, a time or a date and is in a stand-by state for a user.

* * * * *